US007241160B2

(12) United States Patent
Yang

(10) Patent No.: US 7,241,160 B2
(45) Date of Patent: Jul. 10, 2007

(54) SHIELDED ELECTRICAL CONNECTOR FOR CAMERA MODULE

(75) Inventor: Meng-Huan Yang, Tu-Cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/542,831

(22) Filed: Oct. 3, 2006

(65) Prior Publication Data

US 2007/0077823 A1 Apr. 5, 2007

(30) Foreign Application Priority Data

Oct. 3, 2005 (TW) ..... 94217081 U

(51) Int. Cl.
*H01R 13/62* (2006.01)

(52) U.S. Cl. ..... 439/330; 439/71

(58) Field of Classification Search ..... 439/607, 439/330, 71, 68, 70, 331, 73
See application file for complete search history.

(56) References Cited

U.S. PATENT DOCUMENTS 6,862,804 B2 4/2004 Nishio
7,029,308 B2 * 4/2006 Wada ..... 439/330

* cited by examiner

*Primary Examiner*—Avaid H. Nasri
(74) *Attorney, Agent, or Firm*—Wei Te Chung

(57) ABSTRACT

An electrical connector (100) adaptor for soldering on the printed circuit board and electrically connecting with a camera module (4), comprises an insulative housing (1), a plurality of terminals (2) received in the housing and a shield (3) enclosing the housing. The housing defines a receiving room (10) therein for receiving the camera module and a plurality of openings (130) thereon. Each terminal comprises a contacting portion (24) extending into the receiving room and a tail portion (22) electrically connecting with the printed circuit board. The shield comprises a plurality of surfaces (31, 32) enclosing the insulative housing, each surface forms a resilient tab (33) bent from an edge thereof and passing through the opening of the housing.

16 Claims, 5 Drawing Sheets

SHIELDED ELECTRICAL CONNECTOR FOR CAMERA MODULE

BACKGROUND OF THE INVENTION

1. Field of the Invention

The present invention relates to an electrical connector, and particularly to an electrical connector having a shield for electrical connecting with a camera module.

2. Description of Prior Arts

With development of cellular mobile phones or the likes, a lot of additional functions such as taking pictures etc. are added to the mobile phones or the likes. In order to achieve functions such as taking pictures etc., camera modules are furnished to the mobile phones or the likes in virtue of module connectors.

A normal modular connector defines a chamber for accommodating the camera module and comprises a plurality of contacts disposed on side walls of the chamber. A shield encloses the housing for anti-EMI. The shield forms a plurality of resilient tabs for retaining the camera module. However, Each resilient tab is bent inwardly from the shield and leaves a cutout on the shield. Therefore, the cutouts decrease the affection of the anti-EMI of the shield.

Obviously, it is desirable to have an electrical connector with an improved structure.

SUMMARY OF THE INVENTION

An object of the present invention is to provide an electrical connector having an improved shield with a better affection of the anti-EMI.

To achieve the above object, an electrical connector adaptor for soldering on the printed circuit board and electrically connecting with a camera module, comprises an insulative housing, a plurality of terminals received in the housing and a shield enclosing the housing. The housing defines a receiving room therein for receiving the camera module and a plurality of openings thereon. Each terminal comprises a contacting portion extending into the receiving room and a tail portion electrically connecting with the printed circuit board. The shield comprises a plurality of surfaces enclosing the insulative housing, each surface forms a resilient tab bent from an edge thereof and passing through the opening of the housing.

Other objects, advantages and novel features of the invention will become more apparent from the following detailed description of the present embodiment when taken in conjunction with the accompanying drawings.

BRIEF DESCRIPTION OF THE DRAWING

FIG. 3 is a perspective view of the electrical connector when the camera module assembled on;

DETAILED DESCRIPTION OF THE PREFERRED EMBODIMENT

Figure 1:
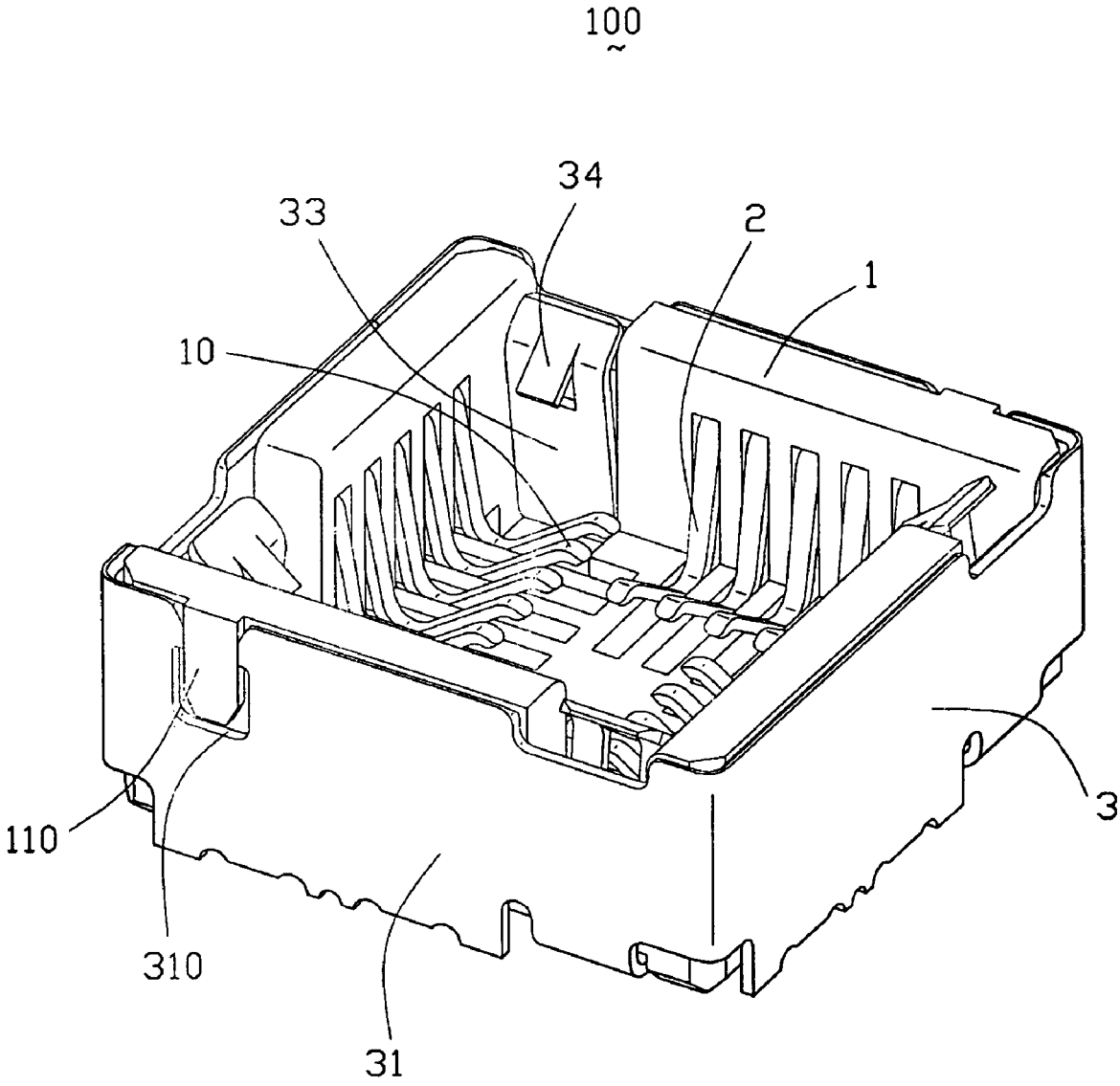
FIG. 1 is an assembled, perspective view of an electrical connector in accordance with the present invention.
Figure 2:
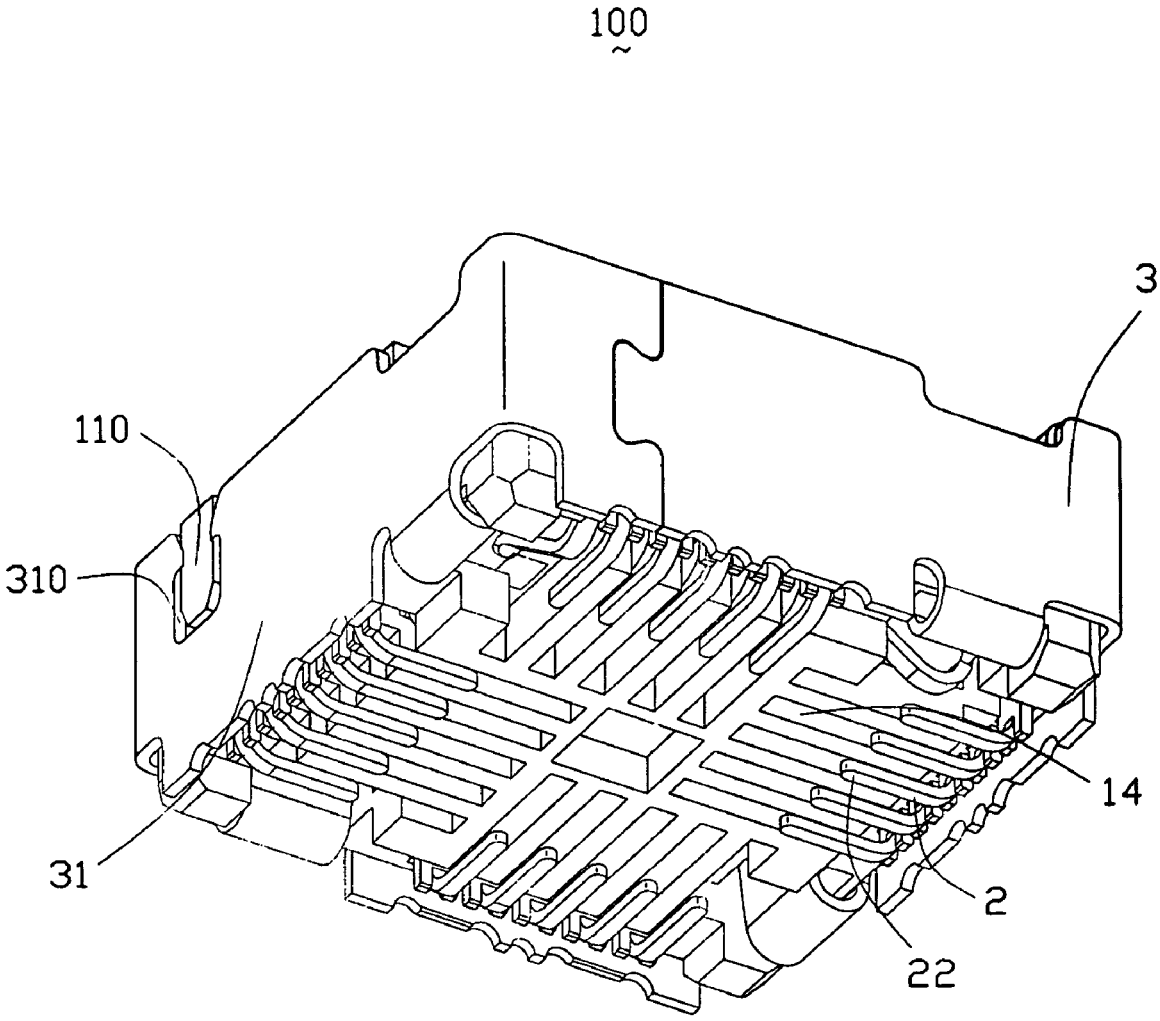
FIG. 2 is a view similar to FIG. 1, but taken from a different aspect.
Figure 3:
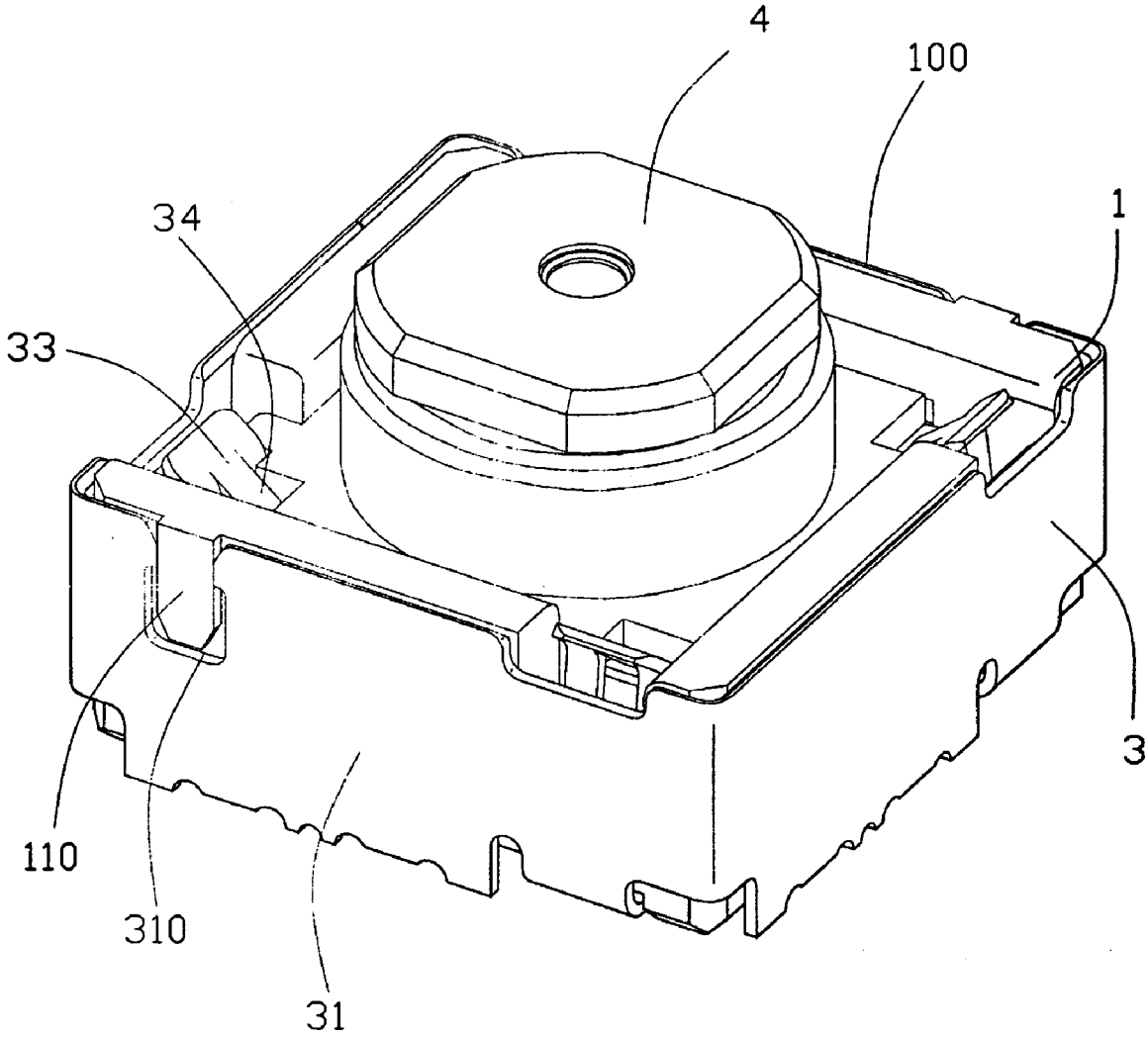
Figure 4:
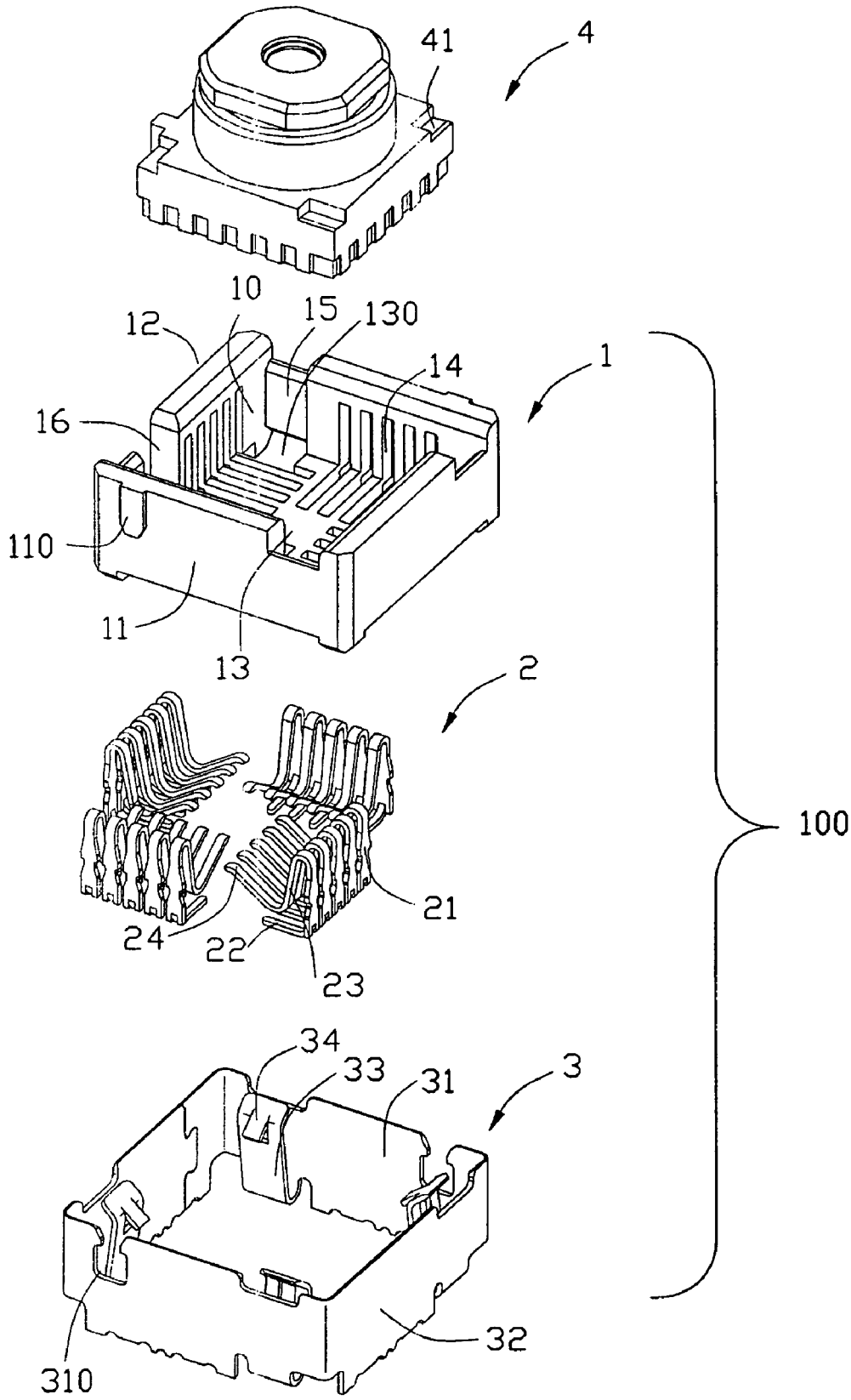
FIG. 4 is an exploded, perspective view of the electrical connector.
Figure 5:
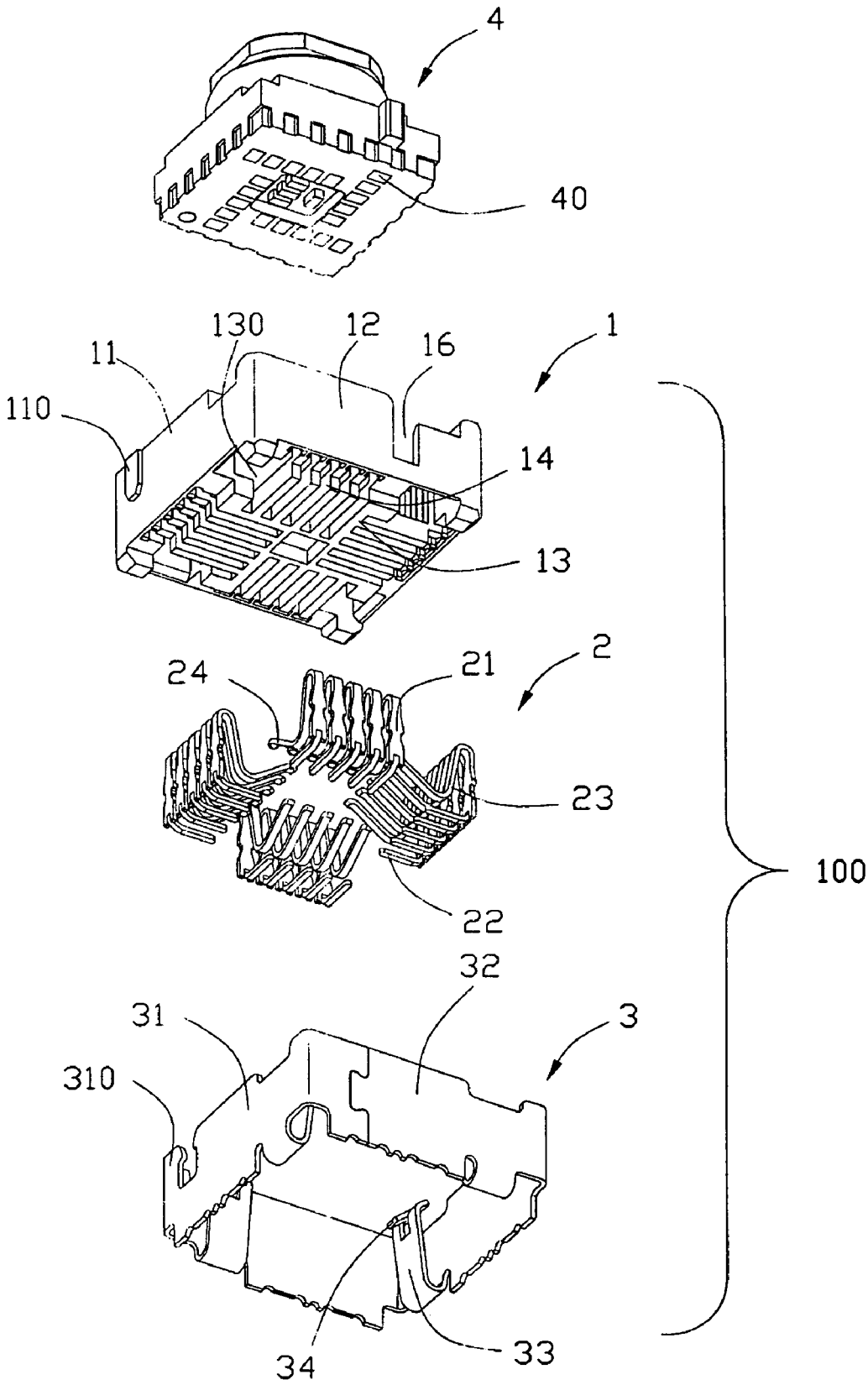
FIG. 5 is a view similar to FIG. 4, but taken from a different aspect.

Referring to FIGS. 1 to 5, an electrical connector 100 comprises an insulative housing 1, a plurality of terminals 2 received in the housing 1 and a shield enclosing the insulative housing 1.

The insulative housing 1 comprises a receiving room 10 and two pair of opposite walls surrounding the receiving room 10. One of the pair of opposite walls in a front-to-back direction are labeled first walls 11, the other pair of opposite in a lateral direction are labeled second walls 12. A bottom wall 13 connects the bottom edges of the first and the second walls 11, 12. Each first and second wall 11, 12 forms a L-shape receiving channel 14 located adjacent the bottom wall 13 and a mounting portion 15. An outer surface of the mounting portion 15 is in a same plane with that of each first and second wall 11, 12, and an inner surface of the mounting portion 15 is lower than that of each first and second wall 11, 12. The bottom wall 13 defines a plurality of openings 130 below the corresponding mounting portions 15. Furthermore, one of the first and second walls 11, 12 defines an anti-mismating cutout 16 for guiding the camera module inserting. Each first wall 11 defines an anti-mismating block 110 at the outer surface thereof.

Each terminals 2 comprises a vertical retaining portion 21, a tail portion 22 extending perpendicularly from a distal end of the retaining portion 21, a resilient portion 23 bent from the retaining portion 21 opposite to the tail portion 22, and a contacting portion 24 forms at a distal end of the resilient portion 23. The retaining portion 21 is partially receivied and retained in the receiving channel 14 of the insulative housing 1. The tail portions 22 are in a plane with the bottom wall 13 of the insulative housing 1. The resilient portions 23 and the contacting portions 24 extend into the receiving room 10 of the insulative housing 1.

The shield 3 configured to the housing 1, comprises a pair of first faces 31 enclosing the outer surface of the first walls of the housing 1, and a pair of second faces 32 enclosing the outer surface of the second walls of the housing 1. Each first faces 31 and second faces 32, comprises a resilient tab 33 extending downwardly and inwardly from the bottom edge thereof. Each resilient tab 33 corresponding to the mounting portion 15 of the housing 1, forms a bar 34 at the distal end thereof. Each second face 32 comprises a cutout 310 engaging with corresponding to the block 110 of the housing 1 adapted for retaining the shield 3 on the housing 1.

During assembly, the terminals 2 and the shield 3 are inserted into corresponding receiving channels 14 in a down-to-up direction. The resilient tabs 33 of the shield 3 extend through corresponding openings 130 into the receiving room 10 of the housing 1. A plurality of gaps (not labeled) are defined between the resilient tabs 33 and the inner surface of corresponding first and second faces 31, 32. Each mounting portion 15 of the housing 1 is located in corresponding gaps and has a certain distance with corresponding resilient tab 33.

The camera module 4 is inserted into the receiving room 10 of the housing 1 in an up-to-down direction, and comprises a plurality of conductive pads 40 adapted for electrically connecting with corresponding contacting portions 24 of the terminals 2. Each resilient tab 33 of the shield 3 resists on the camera with the bar 34 engaging with a corresponding mating face 41 of the camera module 4. Therefore, the camera module 4 is firmly retained on the housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim

1. An electrical connector adaptor for soldering on the printed circuit board and electrically connecting with a camera module, comprising: an insulative housing defining a receiving room therein for receiving the camera module and a plurality of openings thereon; a plurality of terminals, each comprising a contacting portion extending into the receiving room and a tail portion electrically connecting with the printed circuit board; and a shield comprising a plurality of surfaces enclosing the insulative housing, each surface forming a resilient tab bent from a edge thereof and passing through in a down-to-up direction the opening of the housing; wherein the resilient tab comprises a bar for engaging and retaining with the camera module.

2. The electrical connector us described in claim 1, wherein the insulative housing comprises two pairs of opposite walls surrounding the receiving room.

3. The electrical connector as described in claim 2, wherein the surfaces of the shield enclosing corresponding walls of the housing, each resilient tab has a distance with corresponding surface of the shield.

4. The electrical connector as described in claim 3, wherein the housing comprises a plurality of mating portions formed at the walls adjacent corresponding openings, and between the resilient tabs and the surfaces of the shield.

5. The electrical connector assembly as described in claim 2, wherein the housing defines a plurality of L-shape receiving channels at the two pairs of the walls and bottom walls.

6. The electrical connector as described in claim 5, wherein each terminal comprises a retaining portion retained in the receiving channels.

7. The electrical connector as described in claim 1, wherein the bar is formed at the distal end of the resilient tab.

8. The electrical connector as described in claim 1, wherein said housing forms an anti-mismating blocks, the shield defines an anti-mismating cutouts corresponding blocks.

9. An electrical connector comprising: an insulative housing defining a circumferential wall receiving room; surrounding a plurality of terminals disposed in the housing and surrounding said receiving room; a metallic shield surrounding said circumferential wall, at least one spring tang upwardly extending from a bottom section of the shield; wherein said shield and said housing are configured to be assembled to each other under a condition the housing is downwardly assembled to the shield: wherein said spring tang further includes a locking bar for holding a module in the receiving room.

10. The connector as claimed in claim 9, wherein the housing includes a bottom wall under said receiving room, and an opening is defined proximate a joint portion of said bottom wall and said circumferential wall for receiving said upwardly extending spring tang.

11. The connector as claimed in claim 9, wherein stopping means is formed on the shield and the housing for fastening the shield to the housing in position.

12. The connector as claimed in claim 9, wherein said spring tang is laterally hidden behind the corresponding circumferential wall.

13. An electrical connector assembly comprising: an insulative housing defining a circumferential wall surrounding a receiving room; a plurality of terminals disposed in the housing and surrounding said receiving room; a metallic shield surrounding said circumferential wall, at least one spring tang upwardly extending from a bottom section of the shield; wherein said shield and said housing are configured to be assembled to each other under a condition that the housing is downwardly assembled to the shield; wherein a camera module is received in the receiving room, mechanically and electrically connected to the terminals, and held by said spring tang; wherein said spring tang further includes a locking bar for holding said module in the receiving room.

14. The connector as claimed in claim 13, wherein the housing includes a bottom wall under said receiving room, and an opening is defined proximate a joint portion of said bottom wall and said circumferential wall for receiving said upwardly extending spring tang.

15. The connector as claimed in claim 13, wherein said stopping means is formed on the shield and the housing for fastening the shield to the housing in position.

16. The connector as claimed in claim 13, wherein said spring tang is laterally hidden behind the corresponding circumferential wall.

* * * * *